US006073281A

United States Patent [19]

Huber

[11] Patent Number: 6,073,281

[45] Date of Patent: Jun. 13, 2000

[54] SLATTED BEDFRAME

[76] Inventor: Josef Huber, Herakhstrasse 9a, A-4810 Gmunden, Austria

[21] Appl. No.: 09/142,578

[22] PCT Filed: Mar. 10, 1997

[86] PCT No.: PCT/AT97/00047

§ 371 Date: Sep. 10, 1998

§ 102(e) Date: Sep. 10, 1998

[87] PCT Pub. No.: WO97/33500

PCT Pub. Date: Sep. 18, 1997

[30] Foreign Application Priority Data

Mar. 12, 1996 [AT] Austria ..... 134/96 U

[51] Int. Cl.[7] ..... A47C 23/06

[52] U.S. Cl. ..... 5/238; 5/236.1; 5/241

[58] Field of Search ..... 5/236.1, 237, 238, 5/241, 191

[56] References Cited

U.S. PATENT DOCUMENTS

| | | | |
|---|---|---|---|
| 3,813,713 | 6/1974 | Kipfer | 5/238 |
| 4,567,615 | 2/1986 | Fanti | 5/237 X |

FOREIGN PATENT DOCUMENTS

| | | | |
|---|---|---|---|
| 393210 | 2/1991 | Austria . | |
| 394937 | 1/1992 | Austria . | |
| 400920 | 9/1995 | Austria . | |
| 000511 | 11/1995 | Austria . | |
| 0385121 | 9/1990 | European Pat. Off. . | |
| 0397069 | 11/1990 | European Pat. Off. | 5/236.1 |
| 0428227 | 5/1991 | European Pat. Off. . | |
| 0561764 | 9/1993 | European Pat. Off. . | |
| 0632982 | 1/1995 | European Pat. Off. . | |
| 8407599 | 6/1984 | Germany . | |

*Primary Examiner*—Michael F. Trettel
*Attorney, Agent, or Firm*—Collard & Roe, P.C.

[57] ABSTRACT

A slatted bedframe (2) consists of an upper and a lower layer of transverse slats (3) arranged one beside the other with a distance, and of longitudinal, rubber-elastic supporting members (4) inserted between the layers of slats, which at the upper and lower surfaces have receiving lugs (5) for inserting or passing through the slats (3).

To achieve an easily fabricable slatted bedframe with a high resting comfort, the supporting members (4) themselves form the receiving lugs (5) for the slats (3), where the receiving lugs (5) are integral with separate sections (9) protruding upwards and downwards from an oblong central piece (7) of the supporting member (4).

2 Claims, 2 Drawing Sheets

51
6
II
51
10
11
10
6
41
3
4
6
5
10
11
6
11
10
3
2
6
6
41
II
51
10
11

12
1
12
41
51
51
4
5
5
2
3
41
51
51
12
12

SLATTED BEDFRAME

BACKGROUND OF THE INVENTION

1. Field of the Invention

This invention relates to a slatted bedframe, comprising an upper and a lower layer of transverse slats arranged one beside the other with a distance, and longitudinal rubber-elastic supporting members, which have receiving lugs at their upper and lower surfaces for inserting or passing through the slats.

2. Description of the Prior Art

Slatted bedframes comprising two layers of slats arranged one above the other have already gained wide acceptance as bed inserts for accommodating a mattress or the like, since their spring characteristic can be adjusted within relatively wide ranges, where up to now the rubber-elastic supporting members between the layers of slats have consisted of prismatic elastic members continuous along their length, which are surrounded by a fabric sheath or the like that forms receiving lugs for the slats at the upper and lower surfaces thereof (AT-B 394 937). Therefore, these supporting members are relatively complex and lead to a longitudinally continuous supporting surface for the wooden slats resting against the same, so that the slats disposed one beside the other mutually influence each other under a load, and the adaptation of the restoring forces resulting from the load to the respective body of a person resting on the same remains unsatisfactory above all in the vicinity of the increased local loads around pelvis and shoulders.

It has also already been proposed that each of the slats of the two layers of slats arranged one above the other should be combined in pairs by means of individual spring-elastic molded bodies, where each of the two slats positively engages in receiving lugs of the molded bodies connected with each other by spacer rings (German Utility Model G 84 07 599.6), or has been inserted in recesses of block-shaped molded bodies (AT-B 393 210), but this requires a multitude of individual molded bodies, and the slats must additionally be fixed at the bedframe or the molded bodies must be connected with each other by holding straps. The handling of these bedframes is rather complex, and because of the rigid design of the individual molded bodies, which is required to ensure tilt resistance, a sufficient positional adaptation of the slats to the body contour of a person resting on the same can hardly be achieved.

SUMMARY OF THE INVENTION

It is therefore the object underlying the invention to eliminate these deficiencies and create a slatted bedframe as described above, which is characterized by its inexpensive manufacture and easy handling and above all by its far-reaching and sensitive adaptability and supporting effect.

This object is solved by the invention in that the supporting members themselves constitute the receiving lugs for the slats in a manner known per se, where the receiving lugs are integral with separate sections protruding upwards and downwards from an oblong central piece of the supporting member. These supporting members can basically be manufactured in any length and both provide for the mutual support of the two layers of slats disposed one above the other and for the coherence of the entire slatted bedframe, which can thus be handled like a so-called rolling bedframe. For completing the bedframe, the individual slats need merely be pushed through the receiving lugs of the supporting members, so that it is possible at the same time to provide for an individual adjustment of the supporting effect by accordingly positioning the supporting members along the slats. To ensure a proper support of the slats, at least two supporting members should be provided at the two longitudinal sides, but for adjusting the spring characteristic to the respective conditions, three or four longitudinal supporting members will be used. Since the receiving lugs are each integral with a separate section of the supporting member, each slat is supported individually so to speak, and leaves the adjacent slats largely unaffected under a load, which leads to an orthopedically correct supporting effect for the resting body. The supporting members are expediently made of natural rubber, where they may constitute hollow cylindrical sections axially parallel to the receiving lugs and preferably a central piece having equidirectional holes, so as to specifically influence the elastic properties of the supporting members in a material-saving way.

When the supporting members are composed along their length of individual supporting-member pieces, which in the end portions have connecting portions laterally overlapping each other with aligned receiving-lug parts for commonly receiving one slat each, inconveniently long supporting members can be avoided, and the supporting members can be combined in any desired length from individual shorter portions. These supporting-member pieces provide for an economic mass production, and with one and the same supporting-member pieces all kinds of slatted bedframes can then be composed. The connecting portions provide for a simple and reliable connection, which is automatically obtained by pushing the slats through the receiving-lug parts. Due to the profiled structure of the supporting members it is also easily possible to cut up the supporting members and in exceptional cases produce corresponding supplementary pieces for unstandardized bed formats.

It is particularly advantageous when the receiving lugs of the upper surface are offset with a gap with respect to the receiving lugs of the lower surface, and possibly the supporting-member pieces have the connecting portions on the upper surface at one end and on the lower surface at the other end, as in this way the loads will be more uniform and the individual supporting effect of the individual slats can be improved.

BRIEF DESCRIPTION OF THE DRAWING

In the drawing, the subject-matter of the invention is represented purely schematically with reference to an embodiment, wherein.

DESCRIPTION OF THE PREFERRED EMBODIMENT

Figure 1:
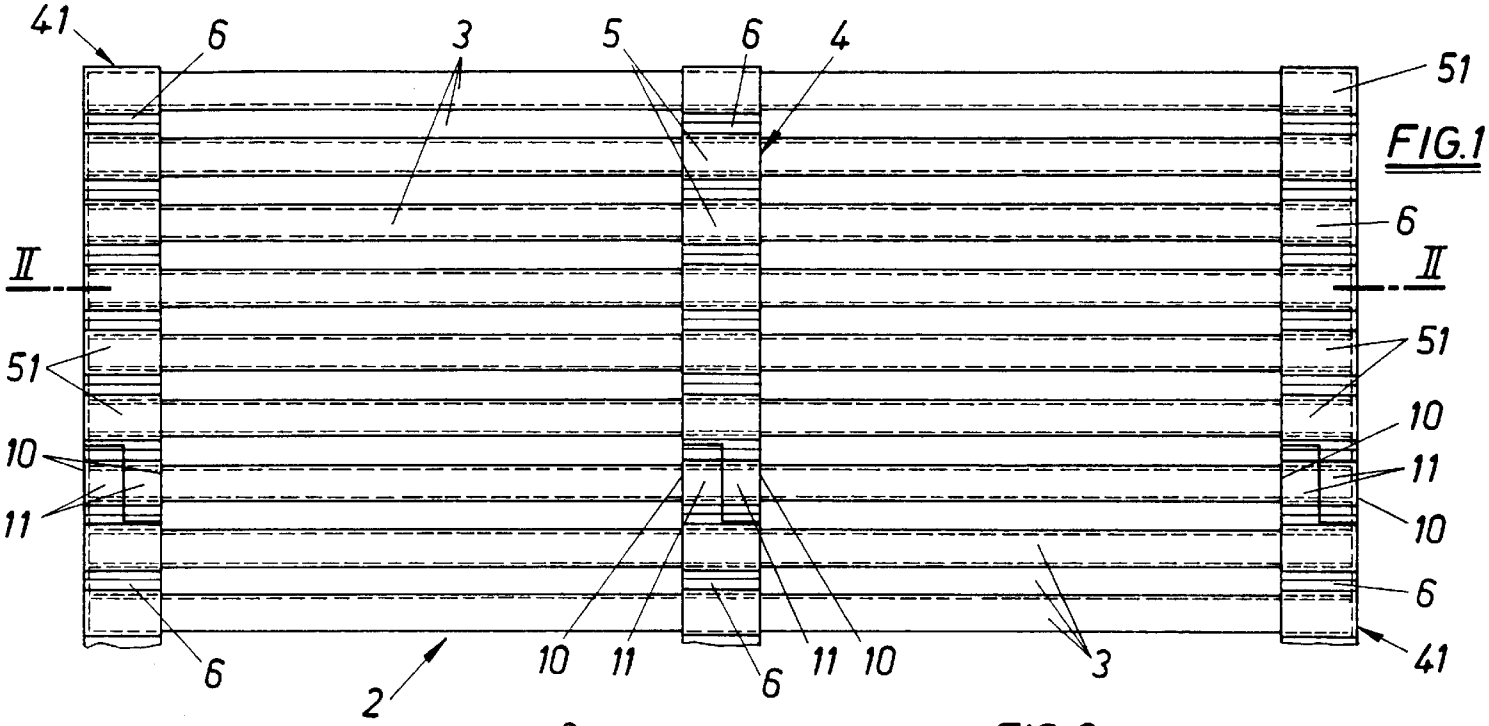
FIGS. 1 and 2 represent part of an inventive slatted bedframe in a top view and in a cross-section along line II—II of FIG. 1, and FIGS. 3 and 4 represent a supporting-member piece of this slatted bedframe in a side view and in a bottom view on an enlarged scale.

A slatted bedframe 2 inserted in an only indicated bedstead 1 consists of an upper and a lower layer of transverse wooden slats 3 disposed one beside the other with a distance, and of rubber-elastic supporting members 4 inserted between the layers of slats and arranged in three longitudinal rows. These supporting members 4, which are continuous over the entire length of the slatted bedframe, have receiving lugs 5 at the upper and lower surfaces for inserting or passing through the wooden slats 3, and are each composed of several, for instance eight, supporting-member pieces 6.

Figure 3:
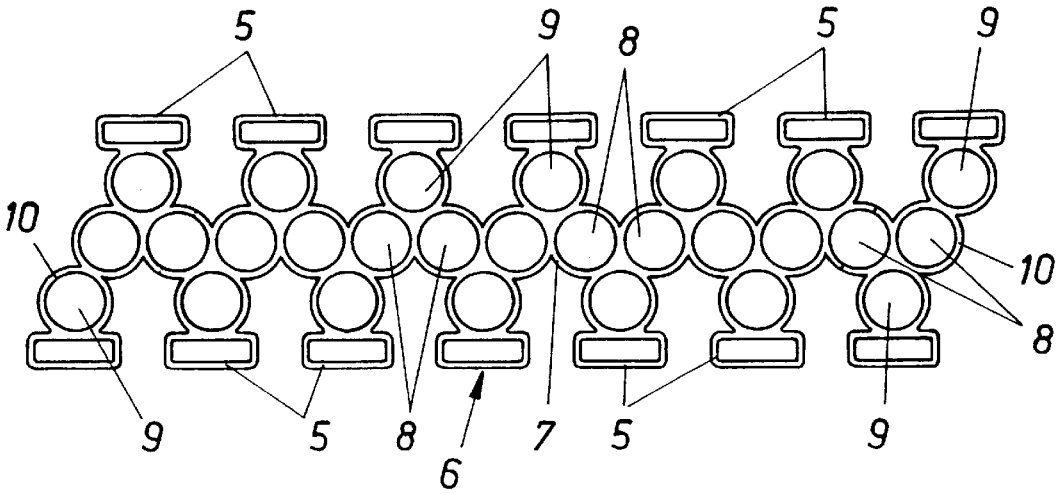
Figure 4:
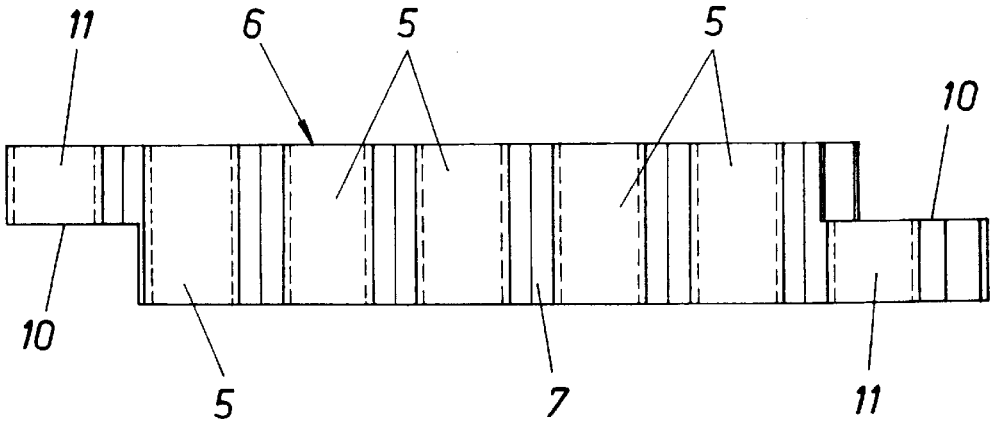

As is indicated in particular in FIGS. 3 and 4, a supporting-member piece 6 comprises an oblong central piece 7 with a row of holes 8 as well as at the upper and lower surfaces individually protruding hollow cylindrical sections 9 corresponding in number to the receiving lugs 5, where a receiving lug 5 is integral with each of these sections. The sections 9 and the receiving lugs 5 of the upper surface are offset with a gap with respect to those of the lower surface, and for a mutual connection the end portions of the supporting-member pieces are provided with connecting portions 10 with receiving-lug parts 11 corresponding to half the width of a supporting member and laterally offset with respect to each other. Upon assembly, these connecting portions 10 overlap each other, and the slats put through the aligned receiving-lug parts 11 at the same time provide for the firm connection of the adjacent supporting-member pieces 6.

Since the supporting members 4 are composed of individual pieces, they can be designed in various ways and also be combined with appropriate special end pieces, so that any type of slatted bedframe can be manufactured in an economic way.

Figure 2:
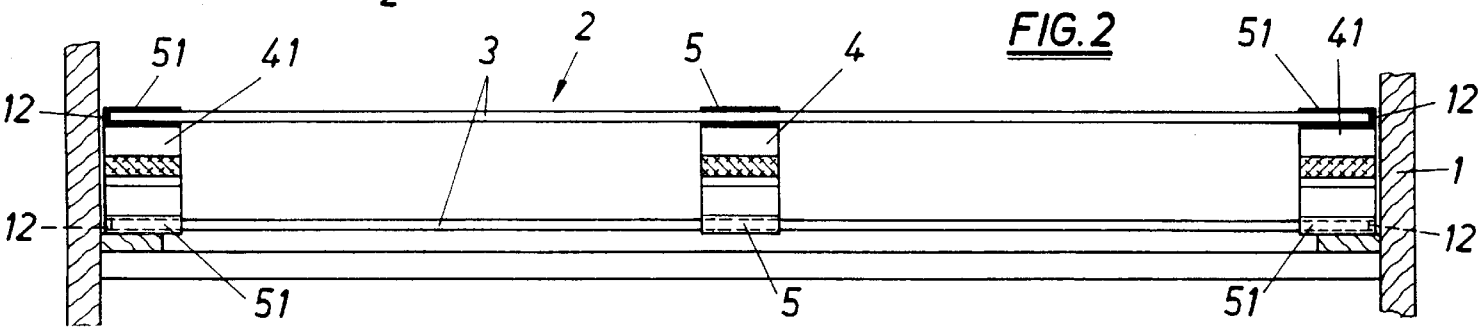

As is indicated in FIG. 2, the receiving lugs 51 of supporting members 41 provided at the edges may have external covers 12, in order to prevent the slats 3 from laterally slipping out due to supporting movements and the like. When manufacturing the supporting members, this cover 12 can simultaneously be manufactured in the form of a web, but also as a closed cap.

The special design of the supporting members 4 provides for a slatted bedframe which can be manufactured economically and is easy to handle, and which is characterized by its adaptability and its special resting comfort.

I claim:

1. A slatted bedframe for a bed, consisting of an upper and a lower layer of slats extending transversely to the longitudinal axis of the bed and arranged one beside the other by a distance, and of rubber-elastic supporting members extending in the direction of the longitudinal axis of the bed and inserted between the layers of slats, the rubber-elastic supporting members having upper and lower surfaces forming receiving lugs for inserting the slats and passing the slats therethrough the receiving lugs being integral with separate sections protruding upwards and downwards from a central piece of the supporting members, and the receiving lugs of the upper surface being offset with respect to the receiving lugs of the lower surface.

2. The slatted bedframe as claimed in claim 1 wherein the supporting members are composed along their length of individual supporting-member pieces having end portions forming connecting portions laterally overlapping each other with aligned receiving-lug parts for commonly accommodating one slat each.

* * * * *